US008479480B2

(12) United States Patent
Dias et al.

(10) Patent No.: US 8,479,480 B2
(45) Date of Patent: Jul. 9, 2013

(54) PACKAGING ASSEMBLY COMPRISING LIGHTWEIGHT CONTAINERS AND MANUFACTURING PROCESS

(75) Inventors: Rodrigue Dias, Worms (DE); Cyrille Durand, Cos Cob, CT (US)

(73) Assignee: Nestle Waters Management & Technology, Issy-les-Moulineaux (FR)

( * ) Notice: Subject to any disclaimer, the term of this patent is extended or adjusted under 35 U.S.C. 154(b) by 511 days.

(21) Appl. No.: 12/515,929

(22) PCT Filed: Nov. 20, 2007

(86) PCT No.: PCT/EP2007/062560

§ 371 (c)(1), (2), (4) Date: Oct. 21, 2009

(87) PCT Pub. No.: WO2008/061977

PCT Pub. Date: May 29, 2008

(65) Prior Publication Data

US 2010/0037559 A1 Feb. 18, 2010

(30) Foreign Application Priority Data

Nov. 24, 2006 (EP) ..... 06124767

(51) Int. Cl.
*B65B 53/02* (2006.01)

(52) U.S. Cl.
USPC ..... 53/544; 53/543; 53/557; 53/144; 206/432; 206/507; 206/497; 414/792

(58) Field of Classification Search
USPC ..... 53/442, 446, 544, 448, 543, 557, 53/143, 144; 206/432, 427, 507, 422, 504, 206/497, 203; 414/792.4, 792.3, 792
See application file for complete search history.

(56) References Cited

U.S. PATENT DOCUMENTS 2,665,026 A * 1/1954 Katzman ..... 217/22
2,755,923 A * 7/1956 Guilleminot et al. ..... 206/427

(Continued)

FOREIGN PATENT DOCUMENTS

GB 1 243 201 8/1971
GB 1 347 005 2/1974

OTHER PUBLICATIONS

International Search Report PCT/EP2007/062560 Dated Feb. 19, 2008.

*Primary Examiner* — M. Alexandra Elve
*Assistant Examiner* — Andrew M Tecco
(74) *Attorney, Agent, or Firm* — Winston & Strawn LLP

(57) ABSTRACT

A packaging assembly for lightweight containers that includes a secondary packaging for gathering and holding a plurality of individual primary lightweight containers. The secondary packaging includes two layers of thermoplastic shrinkable film enclosing the lightweight containers, with the layers being connected to one another at least partially in the circumference of the secondary packaging. Each of the primary lightweight containers has a container body and a container neck with a neck opening. The lightweight containers are disposed in the secondary packaging in rows forming one single, substantially plane layer, with all containers being oriented with their longitudinal axis (L) forming an angle (α) with the plane of the packaging assembly that is between 0 and 45°. Also, the neck of each container is oriented so as to be at least partially inserted between the bodies of the containers disposed in an adjacent row, such that the necks of the containers in the peripheral rows are turned towards the inside of the layer.

13 Claims, 5 Drawing Sheets

U.S. PATENT DOCUMENTS 3,541,753 A * 11/1970 Katz ..... 53/442
3,572,534 A * 3/1971 Benoit ..... 217/19
3,954,177 A * 5/1976 Faust ..... 206/432
4,671,412 A * 6/1987 Gatten ..... 206/504
4,700,528 A * 10/1987 Bernard ..... 53/398
4,744,464 A * 5/1988 Noe ..... 206/422
4,879,861 A * 11/1989 McAdams ..... 53/435
5,439,110 A * 8/1995 Regan, II ..... 206/427
5,673,792 A * 10/1997 Aikio ..... 206/509
6,182,422 B1 * 2/2001 Andersen et al. ..... 53/442
6,820,743 B2 * 11/2004 Hurley et al. ..... 206/427
7,051,892 B1 * 5/2006 O'Day, Jr. ..... 215/383
7,121,408 B2 * 10/2006 Wilson ..... 206/433
7,574,843 B2 * 8/2009 Koster et al. ..... 53/398
2004/0031711 A1 * 2/2004 O'Malley ..... 206/427
2010/0072095 A1 * 3/2010 Salovaara ..... 206/427

* cited by examiner

PACKAGING ASSEMBLY COMPRISING LIGHTWEIGHT CONTAINERS AND MANUFACTURING PROCESS

This application is a 371 filing of International Patent Application PCT/EP2007/062560 filed Nov. 20, 2007.

BACKGROUND ART

The present invention concerns a packaging assembly comprising lightweight containers. And a process of manufacturing such a packaging assembly.

More particularly, it relates to a secondary film packaging for gathering a plurality of primary lightweight containers which have an ovoid shape.

Today, some products, for instance liquids or semi-liquids for human consumption such as fruit juices, aromatized water, chilled dairy products or mineral water are sold in blow-moulded lightweight containers made out of thermoplastic material.

Such lightweight containers allow to reduce the amount of packaging material such as to decrease the container's cost and be more environmentally friendly. Such containers are used as primary containers and are typically of a very simple structure so as to reduce the complexity of the manufacturing tool, therefore improving the manufacturing process and related cost.

In order to simplify their structure as a maximum, such primary containers are designed with an ovoid shape, and comprise a neck with dispensing opening that is closed, by means of a peelable membrane, or screw cap.

Today, such containers are stored, transported and distributed in bulk, that is to say in large loose bags, form which consumers can take them out after opening the gathering bag.

Such a secondary packaging system however proves to be disadvantageous in many aspects.

First, handling and stackability of such loose bags is very difficult due to the fact the overall shape of the loose bags is indefinite.

Second, such loose bags are not visually attractive for the consumer in the point of sales, because the primary containers contained therein are not presented in a defined way, so that the labels cannot be read correctly, and the general appearance of the containers is not nice to the eye.

Third, the primary containers are somehow not as resistant to impacts or drop as classical containers with thick walls, especially in the region of the neck. Due to the fact that such containers are stored in bulk, the necks are not propped up in place during transportation. In case of accidental fall or shock during transportation or handling, some pressure can be put on the necks, damaging them and causing leakage of some of the containers in the loose bag. Such a technical failure is of course very undesirable.

Forth, due to the high number of primary containers contained within the loose bags, the latter are made out of a thick plastic film to withhold the internal pressure of the primary containers inside. Such thick plastic film is expensive and not environmentally friendly.

The present invention aims at solving the above listed drawbacks and disadvantages of the existing secondary packages for gathering lightweight containers as defined above.

SUMMARY OF THE INVENTION

To this effect, the present invention concerns a packaging assembly comprising a secondary packaging for gathering and holding a plurality of individual primary lightweight containers, said secondary packaging comprising two layers of thermoplastic shrinkable film enclosing said lightweight containers, said layers being connected to one another at least partially in the circumference of said secondary packaging, each of the primary lightweight containers comprising a container body and a container neck comprising itself a neck opening According to the present invention, the packaging assembly is characterized in that said lightweight containers are disposed in said secondary packaging in rows forming one single—substantially plane—layer, all containers being oriented with their longitudinal axis forming an angle with the plane of the packaging assembly that is comprised between 0 and 45°, the neck of each container being oriented so as to be at least partially inserted between the bodies of the containers disposed in the preceding row, and such that the necks of the containers in the peripheral rows are turned towards the inside of said layer.

By longitudinal axis, it is meant the axis of revolution passing through the centre of the neck—the latter having the general shape of a cylinder—, and all the way through the centre portion of the body, down through the bottom portion of the container which is located opposite the neck.

In a preferred embodiment of the present invention, the neck of each container in a row is inserted in between the bottom portions of the bodies of the containers in the adjacent rows.

Furthermore, the angle between the longitudinal axis of each container neck and the plane of the packaging assembly is preferably comprised between 5 and 25°, preferably between 5 and 15°.

Advantageously, the container bodies of the containers are generally ovoid.

In one possible execution of the invention, the lightweight primary containers can be polyethylenetherephtalate (PET) containers containing mineral water.

Another aspect of the present invention is directed to a process for manufacturing a packaging assembly as described above.

More particularly, the present invention provides a manufacturing process for manufacturing a packaging assembly according as described hereinbefore, characterized in that it comprises, in order, the following steps:

(i) placing a layer of shrinkable film above or under a frame so that the total length of film is at least twice the total length or width of the frame, (ii) disposing a plurality of primary lightweight containers over said film and inside the frame so that:

- said lightweight containers are disposed in said secondary packaging in rows forming one single—substantially plane—layer, and
- all containers are oriented with their longitudinal axis forming an angle with the plane of the packaging assembly that is comprised between 0 and 45°, and
- the neck of each container is oriented so as to be at least partially inserted between the bodies of the containers disposed in an adjacent row, and
- the necks of the containers in the peripheral rows are turned towards the inside of said layer, and
- the surface area of the plurality of primary containers corresponds exactly to the surface area inside the frame, (iii) folding the portion of film disposed outside the frame over said plurality of primary containers held inside the frame, (iv) sealing the contours of film so as to form a closed pouch of film around the plurality of primary containers, and (v) placing said closed film pouch in heating means so as to shrink said film tightly around said plurality of primary containers.

Preferably, said surface of film disposed above said frame in step (i), exceeds the surface of said frame in all directions.

BRIEF DESCRIPTION OF THE DRAWINGS

Additional features and advantages of the present invention are described in, and will be apparent from, the description of the presently preferred embodiment which is set out below with reference to the drawings in which.

DETAILED DESCRIPTIONOF THE PREFERRED EMBODIMENTS

Figure 1:
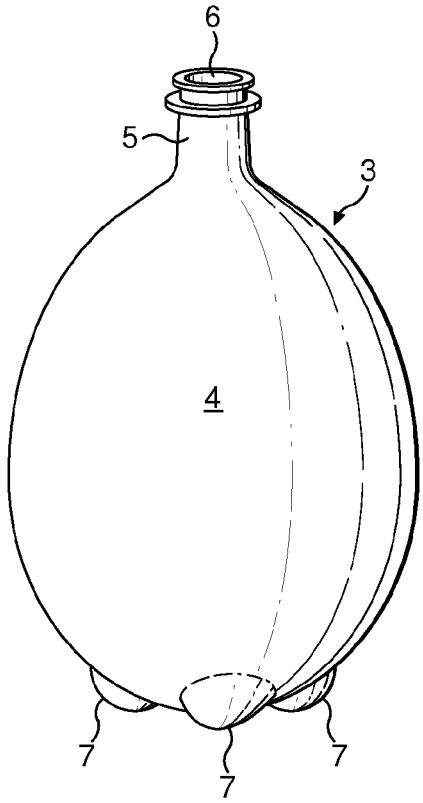
FIG. 1 is a schematic perspective view of a primary lightweight container.

The present invention aims at providing a packaging assembly 1 comprising a secondary film 2 wrapping that encloses and firmly holds a plurality of individual lightweight primary containers 3 in a single layer, FIG. 1 illustrates such a lightweight primary container 3. A lightweight container 3 comprises a container body 4, a container neck 5 and a container delivery opening 6 that is open at the extremity of the container neck 5.

As shown in FIG. 1, the container can be provided with stabilizing means 7 allowing it to stand on a surface in a stable, upright, position, that is to say, wherein the longitudinal axis of the neck 5 is in the vertical position and the container opening 6 is turned upwardly. In the present embodiment of the invention, the stabilizing means comprises three rounded extensions 7 of the container body 4, protruding downwards from the bottom of the latter.

The primary container 3 is made out of a polyethyleneterephtalate (PET) preform that is blow into a mould into a generally ovoid container.

By "lightweight container", it is meant a container with a ratio volume/weight that is comprised between 60 to 120, preferably 80 to 120. Typically, such containers have a wall thickness in the region of the container body that is less than 100 μm, for a volume below 1 liter.

The container opening 6 is closed after filling the container 3 with the contents, for instance mineral water, with any suitable closing means such as peelable film, screw cap, clipped cap, or similar (not represented in the drawing).

Figure 7:
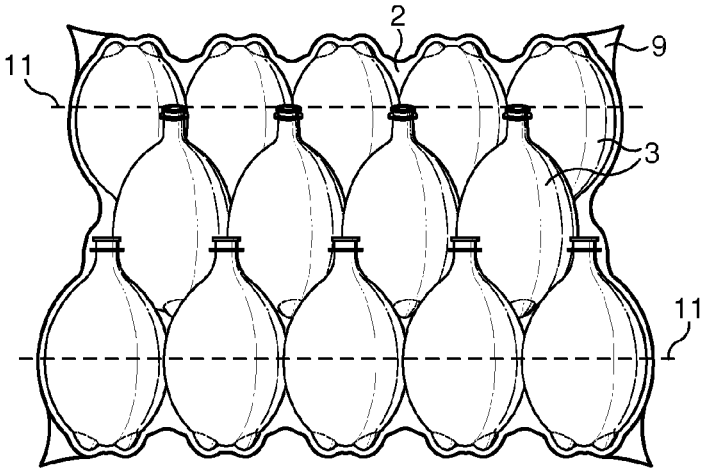
FIG. 7 is a perspective schematic view of a packaging assembly according to the present invention.
Figure 8:
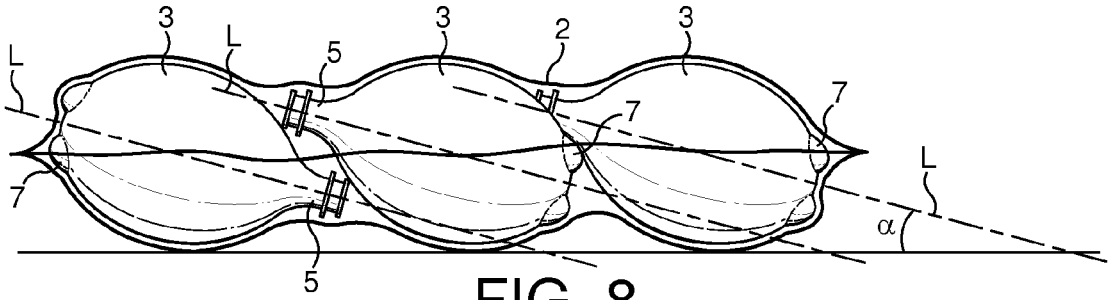
FIG. 8 is a profile schematic view of a packaging assembly according to the present invention.

As shown in FIGS. 7 and 8, the packaging assembly 1 according to the present invention comprises a secondary packaging 2 for gathering and holding a plurality of individual primary lightweight containers 3 as described hereinbefore.

Said secondary packaging 2 comprises two layers of thermoplastic shrinkable film 8 enclosing said lightweight containers 3, said layers 8 being connected to one another in the circumference portion 9 of said secondary packaging 2.

In an alternative embodiment of the invention, some spaces are predetermined in between the primary containers so that the two layers of film forming the secondary packaging can be sealed in some points between the primary containers—and not only at the periphery of said secondary packaging—(not shown in the drawings).

According to the present invention and as illustrated in FIGS. 2, 3, 7 and 8, the lightweight containers 3 are disposed in said secondary packaging in rows forming one single—substantially plane—layer, all containers 3 being oriented with their longitudinal axis L forming an angle $\alpha$ with the plane of the whole packaging assembly 1 that is comprised between 0 and 45°, preferably between 5 and 25°, and more preferably between 5 and 15°.

Furthermore, the neck 5 of each container 3 is oriented so as to be at least partially inserted between the bottom portions 10 of the bodies 4 of the containers 3 disposed in an adjacent row, and such that the necks 5 of the containers 3 in the peripheral rows 11 of one packaging assembly layer are turned towards the inside of said layer.

In another aspect of the present invention, there is provided a process for manufacturing a packaging assembly as described in detail above.

Figure 2:
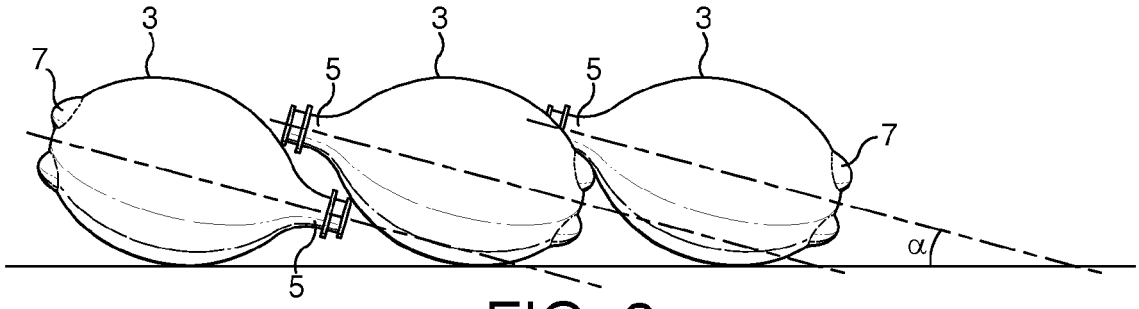
FIG. 2 is an enlarge schematic profile view showing a plurality of primary lightweight containers arranged in one layer as per the invention.
Figure 3:
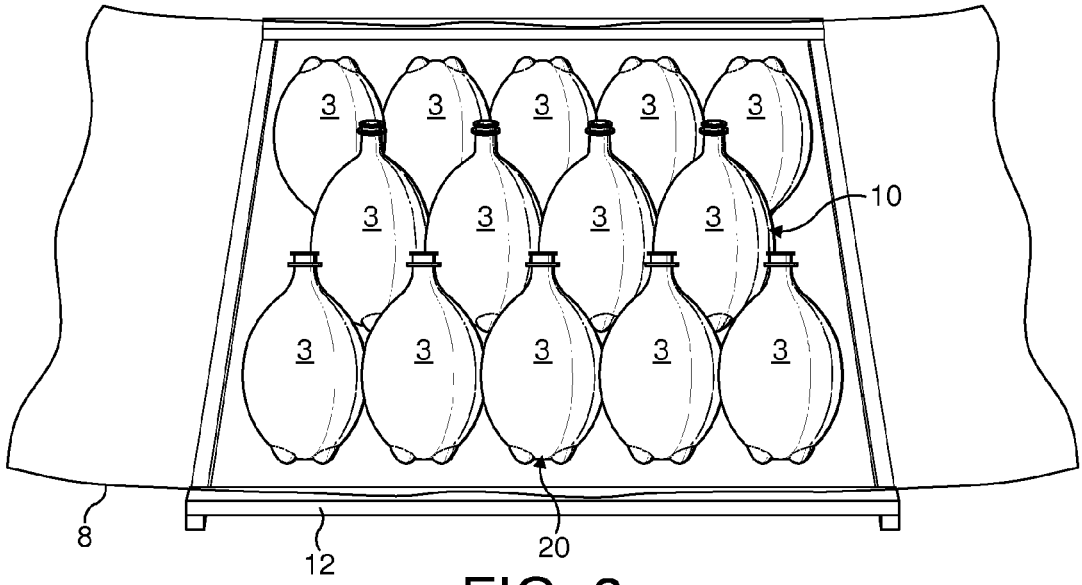
FIG. 3 is a schematic perspective view showing one layer of primary lightweight containers arranged in a frame during the manufacture of a packaging assembly according to the invention.
Figure 4:
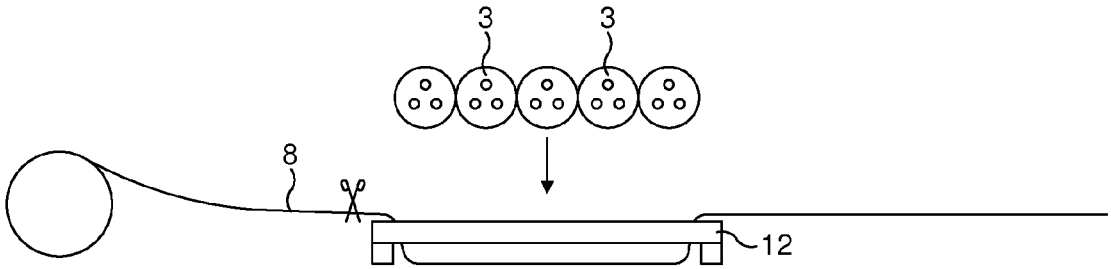
FIG. 4 is a schematic profile view showing the positioning of a plurality of primary containers onto a film disposed onto a frame.
Figure 5:
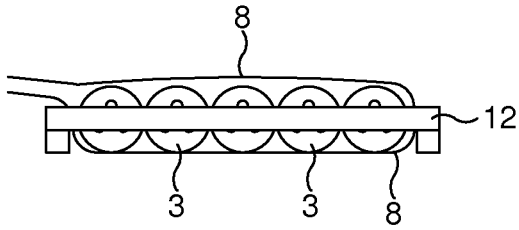
FIG. 5 is a figure similar to FIG. 4 wherein the film is folded onto the plurality of primary containers.
Figure 6:
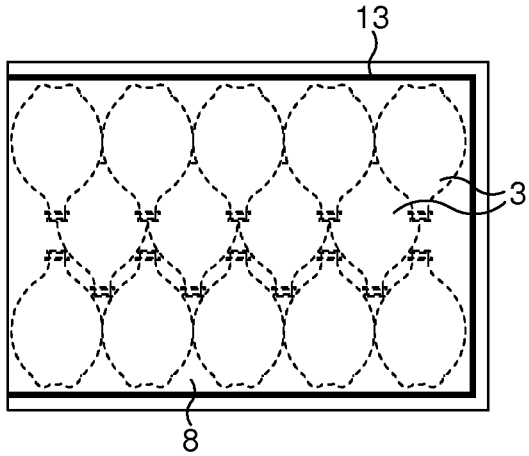
FIG. 6 is a schematic top view showing a sealing jaw applied to some of the contours of the film enclosing the primary containers shown in FIGS. 4 and 5.

According to the invention, this process comprises, in order, the following steps:

(i) placing a layer of shrinkable film above a frame 12 so that the total length of film is at least twice the total length or width of the frame, (ii) as illustrated in FIGS. 2, 3 and 4, disposing a plurality of primary lightweight containers over said film and inside the frame so that:

- said lightweight containers 3 are disposed in said secondary packaging in rows forming one single—substantially plane—layer, and
- all containers are oriented with their longitudinal axis forming an angle with the plane of the packaging assembly that is comprised between 0 and 45°, and
- the neck 5 of each container is oriented so as to be at least partially inserted between the bodies of the containers disposed in an adjacent row, and
- the necks of the containers in the peripheral rows are turned towards the inside of said layer, and
- the surface area of the plurality of primary containers corresponds exactly to the surface area inside the frame—taking into account the functional play—, (iii) folding the portion of film disposed outside the frame over said plurality of primary containers held inside the frame, as shown in FIG. 5, (iv) sealing the contours of film so as to form a closed pouch of film around the plurality of primary containers with sealing means such as sealing jaws 13, as illustrated in FIG. 6, and (v) placing said closed film pouch in heating means so as to shrink said film tightly around said plurality of primary containers so as to form a packaging assembly as shown in FIGS. 7 and 8.

Figure 9:
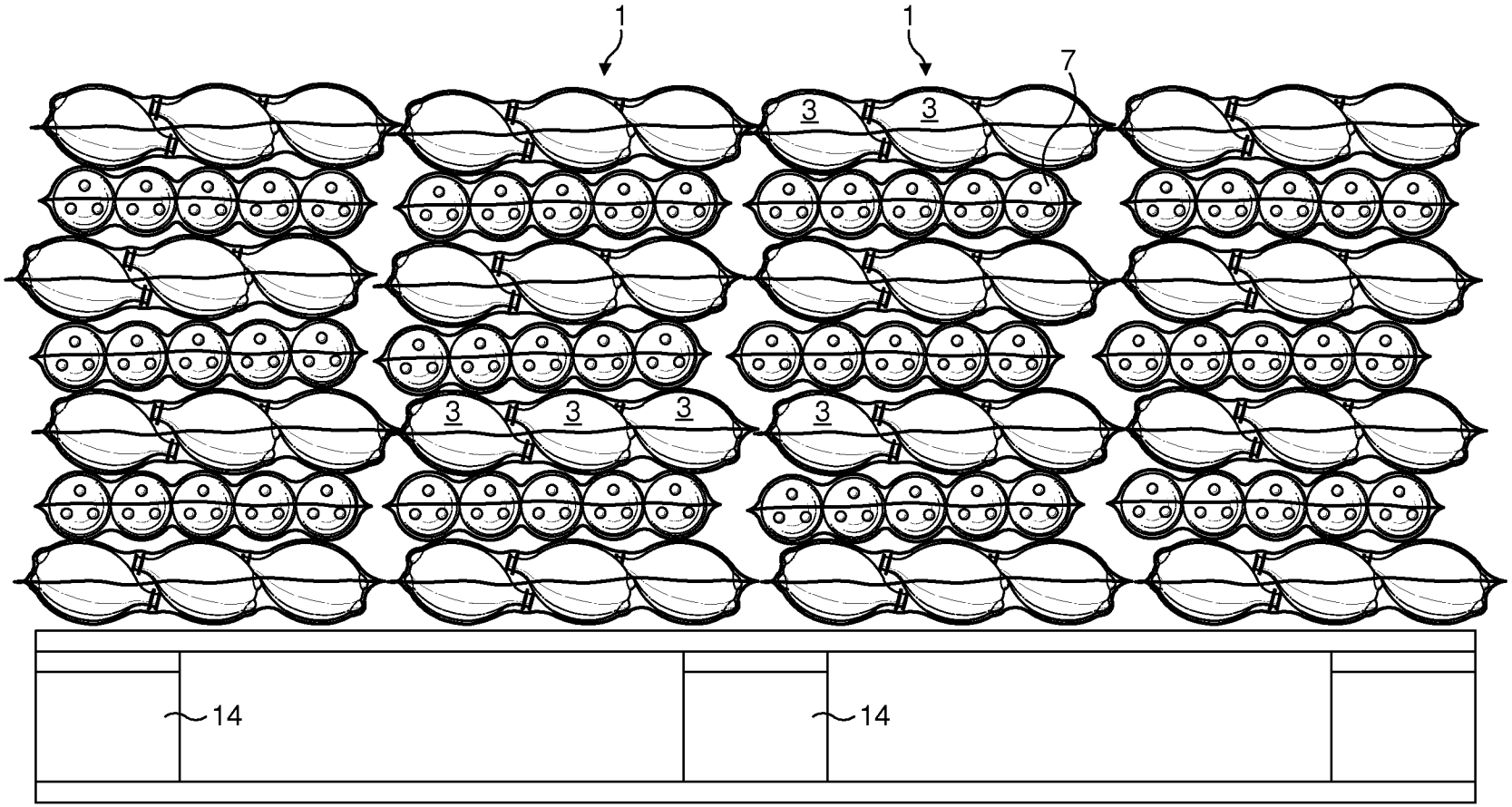
FIG. 9 is a schematic profile view showing a plurality of packaging assemblies according to the invention, piled up in a pallet configuration.

The present invention is particularly advantageous for storing, transporting and presenting lightweight primary containers in a tidy and space-saving way. Particularly, the packaging assemblies according to the present invention can be palletised very easily, as shown in FIG. 9. On a pallet 14, several layers of packaging assemblies 1 are piled up, every other pile being oriented perpendicular to the adjacent top and bottom layers.

Such a pallet configuration stabilizes the different layers together and reinforces the whole pallet, and in some instances where the pallet is not to high, it is possible to avoid the use of a wrapping film enclosing and maintaining the whole pallet.

It should be understood that various changes and modifications to the presently preferred embodiments described herein will be apparent to those skilled in the art. Such changes and modifications can be made without departing from the spirit and scope of the present invention and without diminishing its attendant advantages. It is therefore intended that such changes and modifications be covered by the appended claims.

What is claimed is:

1. A packaging assembly comprising:

multiple rows each containing a plurality of individual lightweight containers;

a secondary packaging for gathering and holding the multiple rows of containers, the secondary packaging comprising thermoplastic shrinkable film also enclosing the multiple rows of lightweight containers, wherein adjacent rows contact each other to form a single, substantially planar layer that is parallel to a horizontal base plane beneath the containers, wherein each row includes a plurality of the containers, with each container having a longitudinal axis and a container body that includes a container neck and neck opening, wherein the bodies of adjacent containers in a row contact each other and the longitudinal axis of each container in the row is parallel to the longitudinal axes of the other containers in the row, wherein the longitudinal axes of all containers in each row form an angle ($\alpha$) of between 5 and 45° with the planar layer and horizontal base plane of the packaging assembly, wherein the necks of each container in a first row all point in the same direction while the necks of each container in a second, adjacent row point in a direction that is opposite to that of the first row, with the necks of the containers in the second row being oriented so as to be at least partially in contact with the bodies of two containers disposed in the first row; and further comprising a third row of containers so that the planar layer includes three rows of containers with the necks of the non-extant containers in the third row being in contact with portions of two containers of the second row and with the necks of all containers in two rows being in the same direction and in a direction opposite to that of the containers in the first row.

2. The packaging assembly of claim 1, wherein the neck of each container in a row is located alongside bottom portions of the container bodies in an adjacent row.

3. The packaging assembly of claim 1, wherein the angle ($\alpha$) between the longitudinal axis of each container and the horizontal base plane of the packaging assembly is between 5° and 25°.

4. The packaging assembly of claim 1, wherein the angle ($\alpha$) between the longitudinal axis of each container and the horizontal base plane of the packaging assembly is between 5° and 15°.

5. The packaging assembly of claim 1, wherein the container bodies are generally ovoid.

6. The packaging assembly of claim 5, wherein the container bodies include stabilizing means such that the bodies can stand in an upright position on a surface.

7. The packaging assembly of claim 1, wherein the lightweight primary containers are polyethylene therephtalate containers containing mineral water and the neck opening includes closing means to retain the water therein.

8. The packaging assembly of claim 1, wherein the lightweight container has a ratio of volume/weight that is between 60 to 120, a wall thickness that is less than 100 microns and a volume of less than 1 liter.

9. The packaging assembly of claim 1, wherein the shrinkable thermoplastic film which tightly surrounds the rows and plurality of containers and maintains them in the recited orientations.

10. The packaging assembly of claim 1, wherein the first and second rows are oriented to be parallel to each other.

11. A pallet stably supporting a plurality of packaging assemblies according to claim 1, wherein each assembly is oriented perpendicular to adjacent top and bottom assemblies.

12. A packaging assembly comprising:

three planar rows each containing a plurality of individual lightweight containers;

a secondary packaging for gathering and holding the multiple rows of containers, the secondary packaging comprising thermoplastic shrinkable film also enclosing the three rows of lightweight containers, wherein the three adjacent rows include a lowermost first row in contact with a second row, and a third row in contact with the second row to form a single, substantially planar layer that is parallel to a horizontal base plane beneath the containers, wherein each row includes a plurality of the containers, with each container having a longitudinal axis and a container body that includes a container neck and neck opening, wherein the bodies of adjacent containers in each row contact each other and the longitudinal axis of each container in each row is parallel to the longitudinal axes of the other containers in the row, wherein the longitudinal axes of all containers in each row form an angle ($\alpha$) of between 5 and 45° with the planar layer and horizontal base plane of the packaging assembly, wherein the necks of each container in the first, lowermost row all point in the same direction while the necks of each container in the second and third rows point in a direction that is opposite to that of the first row, and wherein the necks of the containers in the second row are oriented so as to be at least partially in contact with the bodies of two containers disposed in the first row, and with the necks of the non-extant containers in the third row being oriented so as to be at least partially in contact with the bodies of two containers disposed in the second row; and wherein the thermoplastic shrinkable film maintains the three rows of containers in their recited orientations.

13. A pallet stably supporting a plurality of packaging assemblies according to claim 12, wherein each assembly is oriented perpendicular to adjacent top and bottom assemblies.

* * * * *

UNITED STATES PATENT AND TRADEMARK OFFICE

CERTIFICATE OF CORRECTION

PATENT NO. : 8,479,480 B2
APPLICATION NO. : 12/515929
DATED : July 9, 2013
INVENTOR(S) : Dias et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 778 days.

Signed and Sealed this
Eighth Day of September, 2015

Michelle K. Lee

Michelle K. Lee
*Director of the United States Patent and Trademark Office*